United States Patent [19]

Ashmore

[11] 4,455,151

[45] Jun. 19, 1984

[54] VAPOR INJECTION FUEL COMPOSITION

[76] Inventor: James M. Ashmore, 820 Milwood Rd., Broken Arrow, Okla. 74012

[21] Appl. No.: 436,598

[22] Filed: Oct. 25, 1982

[51] Int. Cl.[3] ..... C10L 1/18

[52] U.S. Cl. ..... 44/53; 44/71; 44/72; 585/14

[58] Field of Search ..... 44/53, 71, 72, 70; 252/386; 585/14

[56] References Cited

U.S. PATENT DOCUMENTS 1,622,572 3/1927 Chandler ..... 44/56

2,673,793 3/1954 Brodhacker ..... 44/53

4,371,377 2/1983 Weinberger ..... 44/77

*Primary Examiner*—Charles F. Warren

*Assistant Examiner*—Margaret B. Medley

*Attorney, Agent, or Firm*—Head, Johnson & Stevenson

[57] ABSTRACT

A fuel additive comprising: for every forty-seven parts by volume of acetone, one part by volume 2-methylpentane, ten parts by volume nitromethane, four hundred fifty parts by volume methanol, and four hundred sixty parts by volume water. Such an additive is useful as the liquid fuel phase in a vapor injection system to a conventional air aspirated carburetor.

6 Claims, No Drawings

VAPOR INJECTION FUEL COMPOSITION

BACKGROUND OF THE INVENTION

1. Field of the Invention

This invention relates to a fuel additive composition for use in the internal combustion engine. More specifically, the invention relates to a fuel additive composition which is useful in a vapor injection system for the conventional air aspirated carburetor engine.

2. Description of the Prior Art

The basic concept of injecting water vapor into a gasoline fueled engine is well known and in some respects, viewed as a legendary process. For example, it is not uncommon to have heard stories about temporary water injection into World War II fighter plane engines for additional power. Similarly, stories about race cars equipped with a water injection system to achieve an additional boost at critical periods in the race have been popularized. Although such stories may generate a certain degree of skepticism, equipment and conversion kits for adding a water vapor injection system to the standard air aspirated automotive carburetor are, in fact, available in specialty type automotive catalogs. Usually the equipment is designed to introduce water vapor saturated air or a mixture of water and alcohol (particularly in winter) at the base of the carburetor through an already available vacuum line, such as the PCV hose or the equivalent.

The reasons and benefits associated with and attributed to the use of contemporary water vapor injection systems are varied. Water injection has been used to reduce the tendency for the engine to ping or knock. This benefit has been attributed in part to the cooling effect (reduced adiabatic flame temperature) which in turn suppresses preignition and undesirable detonation. The presence of water has also been credited with the removal of engine carbon deposits, thus eliminating internal hot spots and reducing the frequency of replacing spark plugs or other long term maintenance problems. Frequently, claims of allowing the engine to operate on a lower octane gasoline at increased power and with gas and mileage savings are attributed to water injection. However, with the contemporary low octane gasolines, the use of water vapor alone has not been entirely satisfactory. Thus, the need for an injection fuel additive that still retains the economy and beneficial characteristics of water vapor, yet supplements the octane rating of the modern gasoline is in principle still present.

SUMMARY OF THE INVENTION

In view of the problems associated with water vapor injection when using modern low octane gasolines, I have discovered an improved vapor fuel additive useful as a substitute for water vapor injection. Thus, the present invention provides a vapor injection fuel additive comprising: for ever forty-seven parts by volume of acetone; up to about one part by volume of a branched $C_6H_{14}$ hydrocarbon, from about eight to about forty parts by volume of nitromethane, from about three hundred fifty to about five hundred fifty parts by volume of an alcohol selected from the group consisting of methanol, ethanol and isopropanol, and up to about four hundred sixty parts by volume of water.

According to one embodiment of the present invention the $C_6H_{14}$ hydrocarbon is 2-methylpentane and the alcohol is methanol. Preferably, the composition involves ten parts by volume nitromethane and about four hundred fifty parts by volume methanol. One particularly economical composition involves one part by volume 2-methylpentane and about four hundred sixty parts by volume water.

It is a primary object of the present invention to provide a fuel additive composition which is useful in vapor injection into a conventional air aspirated carburetor engine. It is an associated object that the composition retain the advantages of water vapor injection, yet be particularly useful in combination with low octane modern fuels. Fulfillment of these objects and the presence and fulfillment of other objects will be apparent upon complete reading of the specification and attached claims.

DESCRIPTION OF THE PREFERRED EMBODIMENTS

According to the preferred embodiments of the present invention, the novel fuel additive is comprised of a blend of specific components in specific amounts or ratios such as to create a single volatile liquid phase (amenable to vacuum induction) that is both hydrocarbon compatible and water miscible. For purposes of this invention, the term hydrocarbon compatible qualitatively means that more than trace amounts of $C_6H_{14}$ hydrocarbon or the like will dissolve in the blend, while water miscible means a significant volume fraction of water can be present. In addition to the desired solubility characteristics of the fuel additive, the individual components are selected to enhance both the fuel energy value of the additive (thereby compensating for the presence of water) and the ultimate octane value and performance characteristics of the gasoline engine. Also of interest are the cleansing characteristics of the additive for the fuel system and the engine, and the overall cost and availability of the components. In view of the above considerations, the present invention employs a series of low molecular weight volatile organic compounds selectively blended into a water containing single phase.

Preferably, the organic portion of the fuel additive comprises a blend of a water soluble ketone, such as acetone, to which has been added a small volume fraction of a branched $C_6H_{14}$ hydrocarbon, such as 2-methylpentane. The mixture is then blended with a two component so-called exotic fuel, such as nitromethane and alcohol. Preferably, all organic compounds are blended or pre-blended as an initial step to the final adding of the water phase.

The role of each individual component in the final fuel additive can be analyzed in terms of its respective effect as a fuel or fuel additive and its respective effect or contribution to the phase behavior and compatibility as a vapor induction fuel additive composition. For example, acetone is known to be an excellent carburetor cleaner and since it is combustible, it contributes to the fuel energy value of the final blend, yet acetone also has a high affinity for and solubility in water, thus representing an attractive additive for creating a single water/hydrocarbon phase. The branched $C_6H_{14}$ hydrocarbon is also known as a fuel, but since it is present in the smallest volume fraction, it is the least significant additive in this respect. However, the $C_6H_{14}$ hydrocarbon (e.g. 2-methylpentane) serves a role in that it is felt to stabilize the fuel additive and in particular indicate and confirm hydrocarbon compatibility of the resulting blend; i.e., the separation of the hydrocarbon from the fuel mixture is an early indication of the onset of hydrocarbon incompatibility.

Similarly, the roles of the nitromethane and alcohol as fuel energy sources and their respective roles as octane boosters when added to gasoline can be readily appreciated. However, rendering the nitromethane sufficiently soluble, particularly in a water containing phase that ultimately functions as a vacuum induction or vacuum injection fuel additive cannot be easily rationalized. It is felt that the role of the acetone and hydrocarbon in combination with the nitromethane and alcohol to effect the desired single phase when added to water is a highly novel and useful aspect of the present invention. Having once achieved a stable solution of the organic liquids, a significant volume of water can then be blended to the organic phase to achieve the desired fuel additive composition. Optionally, a dye or coloring agent can be added to physically identify and distinguish the final product.

The relative proportions of the individual components and the overall sequence of blending is felt to be critical. Preferably, the branched $C_6H_{14}$ hydrocarbon is added to the acetone and then the nitromethane and alcohol are added. If upon standing, hydrocarbon or nitromethane separation takes place, phase instability is indicated. In such cases, the proportions must be either readjusted or an optional distillation be performed. The final distillate or single phase organic blend is then diluted with water to the final desired concentration.

Experience indicates that for about every forty-seven parts by volume of acetone employed in blending the organic phase, up to about one part by volume $C_6H_{14}$ hydrocarbon, from about eight to forty parts by volume nitromethane, and from about three hundred fifty to five hundred fifty parts by volume methanol represent acceptable concentration ranges. Beyond the one part by volume $C_6H_{14}$ hydrocarbon, the hydrocarbon phase tends to separate. Similarly, the nitromethane tends to form a separate phase at higher concentration levels. Preferably, about ten parts by volume nitromethane represents optimum solubility. The relative quantity or concentration of alcohol can vary significantly, with about four hundred fifty parts by volume methanol representing a preferred ratio. The relative quantity of water to be blended with the organic phase that contains forty-seven parts by volume acetone can vary significantly up to about four hundred sixty parts by volume. This relatively water dilute fuel additive is particularly useful as a continuous additive to the modern automobile engine. At lower relative water content (i.e., higher organic phase), the fuel additive has been found to be useful in severe octane deficient situations or as an engine tonic or treatment. All concentrations are viewed as a pragmetic substitute for pure water vapor injection.

In selecting the specific ingredients employed in the present invention, the water soluble highly volatile ketone is preferably acetone, but other low molecularly ketones and diketones such as methylethyl ketones should be considered equivalent. The hydrocarbon can be essentially any branched hexane or highly branched heptane with 2-methylpentane being the preferred component. The alcohol is to be a low molecular weight compound selected from the group consisting of methanol, ethanol, and isopropanol (methanol is preferred). Optionally, other selected fuel additives well known in the art can be dissolved in the final water containing blend for specific known purposes and applications, provided they do not induce phase separation in the fuel additive composition. Thus, it is contemplated that selected additives such as aromatic hydrocarbons, other carbonyl containing cleansing agents, and even upper cylinder lubricants can be added to the fuel blend and thus carried into the internal combustion engine. Also various dyes can be added to the final product to identify and distinguish various grades of the product.

EXAMPLE

To illustrate the preferred direct method of blending ingredients to manufacture the fuel additive composition of the present invention, one gallon of 2-methylpentane, ten gallons of nitromethane, and four hundred fifty gallons of methanol were sequentially added to forty-seven gallons of acetone with gentle stirring. The blend was allowed to stand for a sufficient time to insure that the hydrocarbon phase did not separate. To this mixture was then added four hundred sixty gallons of water, again with gentle stirring. The final ten gallons of water added contained forty-five grams of dissolved Acid Orange Dye #15442. The resulting composition was a single phase orange tinted liquid.

The advantages of using the composition of the present invention in a vapor injection system are numerous. In addition to the previously mentioned beneficial characteristics of the presence of the water vapor, including removal of carbon deposits, suppression of pre-ignition and detonation, improved power and economy and reduced maintenance, the present invention achieves these goals at virtually no sacrifice in octane or fuel energy value. The presence of the nitromethane and alcohol represents an inherent boost in octane of the gasoline. The presence of the acetone in addition to representing a carburetor and engine cleansing agent also contributes to the fuel value and assists in maintaining the other ingredients miscible in a single phase. Similarly, the small amount of hydrocarbon contributes fuel value and phase stability. Thus, the use of the composition is viewed as an octane boost, engine cleanser as well as knock and ping suppressor leading to improved performance and economy, which in turn results in improved longevity of the engine at reduced maintenance.

Having thus described and exemplified the preferred embodiments with a certain degree of particularity, it is manifest that many changes can be made within the details of the invention and the use thereof without departing from the spirit and scope of this invention. Therefore, it is to be understood that the invention is not limited to the embodiment set forth herein for purposes of exemplification, but is to be limited only by the scope of the attached claims, including a full range of equivalents to which each element thereof is entitled.

I claim:

1. A vapor injection fuel additive comprising: for every forty-seven parts by volume of acetone; about one part by volume of a branched $C_6H_{14}$ hydrocarbon, from about eight to about forty parts by volume of nitromethane, from about three hundred fifty to about five hundred fifty parts by volume of an alcohol selected from the group consisting of methanol, ethanol and isopropanol, and up to about four hundred sixty parts by volume of water.

2. A vapor injection fuel additive of claim 1 wherein said $C_6H_{14}$ hydrocarbon is 2-methylpentane.

3. A vapor injection fuel additive of claim 2 wherein said alcohol is methanol.

4. A vapor injection fuel additive of claim 3 further comprising about ten parts by volume nitromethane and about four hundred fifty parts by volume methanol.

5. A vapor injection fuel additive of claim 4 further comprising about one part by volume 2-methylpentane and about four hundred sixty parts by volume water.

6. A single phase liquid fuel for vacuum induction into an air aspirated carburetor comprising:

(a) about forty-seven parts by volume of acetone;
(b) about one part by volume of 2-methylpentane;
(c) about ten parts by volume of nitromethane;
(d) about four hundred fifty parts by volume of methanol; and
(e) about four hundred sixty parts by volume of water.

* * * * *